United States Patent [19]

Schwarzmann

[11] 4,270,104

[45] May 26, 1981

[54] PHASE EQUALIZER IN MICROWAVE TRANSMISSION LINE

[75] Inventor: Alfred Schwarzmann, Mt. Laurel, N.J.

[73] Assignee: RCA Corporation, New York, N.Y.

[21] Appl. No.: 96,823

[22] Filed: Nov. 23, 1979

[51] Int. Cl.[3] ..... H01P 1/20

[52] U.S. Cl. ..... 333/28 R; 333/116; 333/223

[58] Field of Search ..... 333/28 R, 116, 161, 333/164, 223, 235, 238, 246, 247, 263; 334/45

[56] References Cited

U.S. PATENT DOCUMENTS

| | | | |
|---|---|---|---|
| 2,611,822 | 9/1952 | Bliss | 333/246 X |
| 3,512,110 | 5/1970 | Clar | 333/116 |
| 3,768,050 | 10/1973 | Stiles, Jr. | 333/246 |
| 4,121,182 | 10/1978 | Makimoto et al. | 333/116 X |

*Primary Examiner*—Paul L. Gensler

*Attorney, Agent, or Firm*—Samuel Cohen; Carl V. Olson

[57] ABSTRACT

A resonant circuit phase equalizer includes two quarter-wavelength-long strip conductors extending in parallel from adjacent ends of respective input and output strip conductors of a microwave stripline transmission line. A fixed MIS direct-current-blocking and radio-frequency tuning capacitor is connected across the remote ends of the quarter-wave strip conductors. A variable varactor capacitor is connected across the near ends of the quarter-wave strip conductors. A variable direct-current bias voltage is applied through radio frequency choke conductors to the varactor to vary the capacitance thereof and the center frequency tuning of the equalizer.

5 Claims, 8 Drawing Figures

PHASE EQUALIZER IN MICROWAVE TRANSMISSION LINE

This invention relates to the transmission of microwave energy, and particularly to an electrically-controlled phase equalizer for use on a stripline transmission line.

The invention is particularly useful in communications and radar systems in which the microwave energy transmitted occupies a relatively wide frequency band. A phase equalizer is needed because different frequencies propagate at different velocities, and thus some frequency components are delayed longer than others. The result is phase distortion.

In accordance with an example of the invention, an input strip conductor is capacitively coupled to an output strip conductor by two parallel-extending quarter-wavelength-long strip conductors. A fixed capacitor is connected across the remote ends of the quarter-wavelength-long strip conductors, and a variable varactor capacitor is connected across the near ends. Radio frequency choke conductors are connected with the input and output strip conductors through which to supply a variable direct-current bias to the varactor capacitor.

Figure 2:
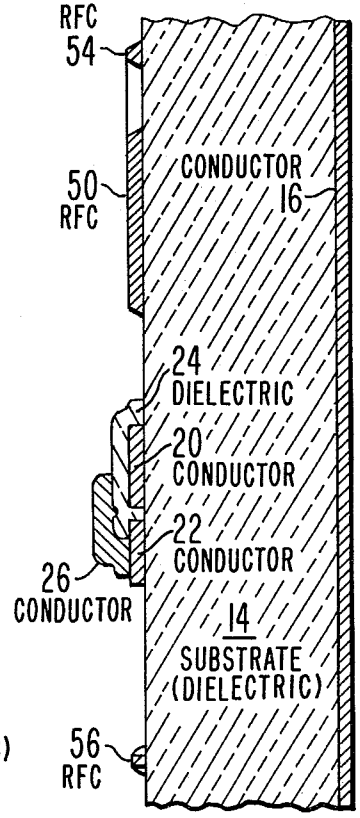
FIG. 2 is a sectional view taken on the line 2—2 of FIG. 1.
Figure 1:
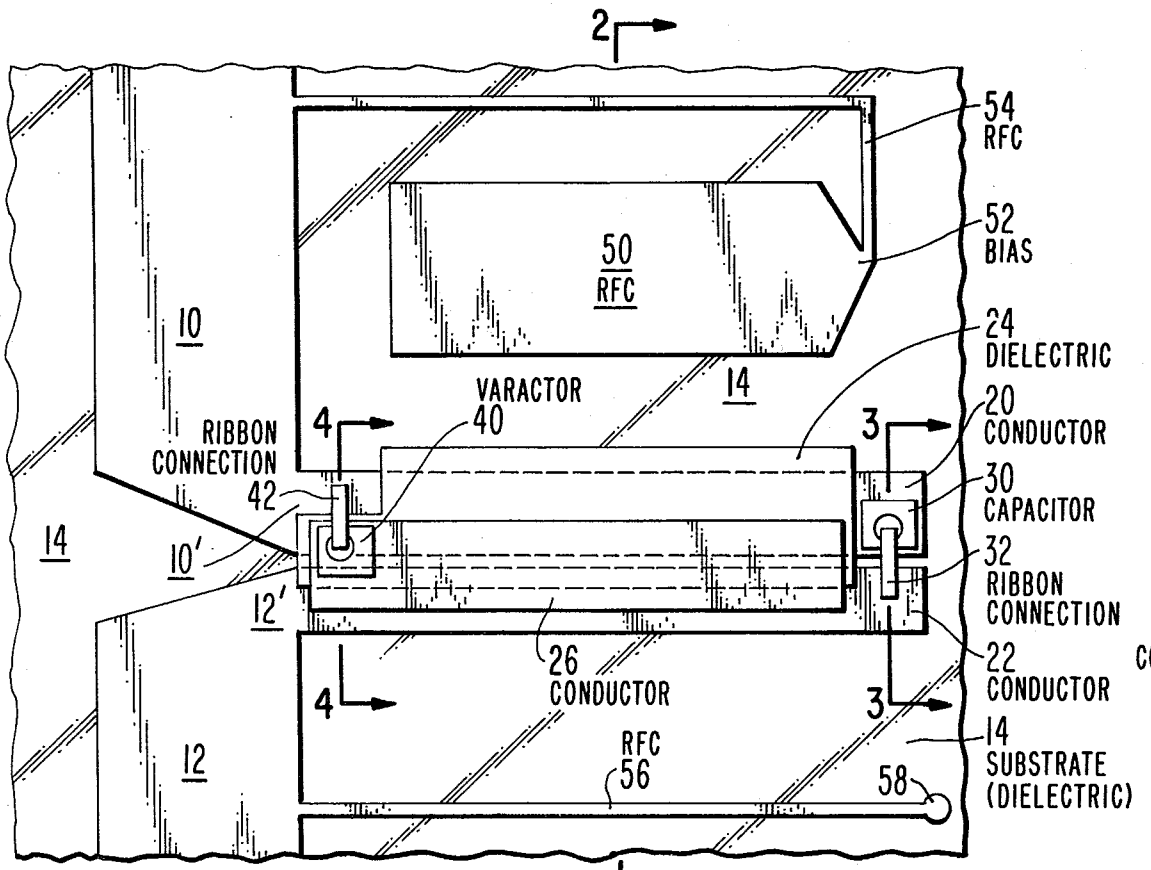
FIG. 1 is a plan view of a transmission system including a phase equalizer constructed according to the teachings of the invention.

Referring now in greater detail to FIGS. 1 through 4, the stripline microwave energy-transmission system includes an input strip conductor 10, and an output strip conductor 12, formed on an insulating dielectric planar substrate 14 having a ground plane conductor 16 on the entire back surface thereof. The end 10' of conductor 10, and end 12' of conductor 12, are connected to, and integral with, two parallel-extending quarter-wavelength-long strip conductors 20 and 22, respectively. The capacitive coupling between conductors 20 and 22 is increased by a quarter-wavelength-long insulating dielectric layer 24 on conductor 20, and by a quarter-wavelength-long conductor 26 which is connected along its length with conductor 22 and which overlays conductor 20. The described construction is such that microwave radio-frequency energy, but not direct current, can be capacitively coupled from input strip conductor 10 to output strip conductor 12.

Figure 3:
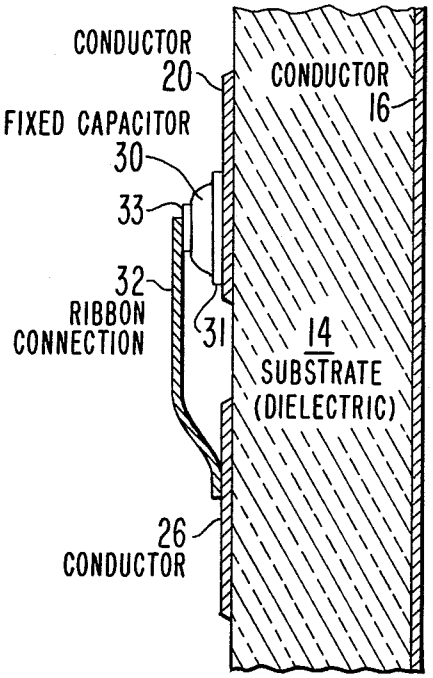
FIG. 3 is a sectional view taken on the line 3—3 of FIG. 1.

As best shown in FIG. 3, a fixed capacitor 30 has one terminal 31 mounted on the remote end of strip conductor 20, and has its other terminal 33 connected by a conductive ribbon 32 to the remote end of strip conductor 22. The fixed capacitor 30 may be a MIS capacitor having a capacitance in the range from about 20 to 100 picofarads to provide direct-current blocking and to help tune the strip conductors 20 and 22 to an effective length of a quarter wavelength at the frequency of interest. The capacitor 30 may be a Model GC 80, 000-00 unit made by GHZ Devices, Division of Frequency Sources, Inc, 16 Maple Road, SO. Chelmsford, MA 01824.

Figure 4:
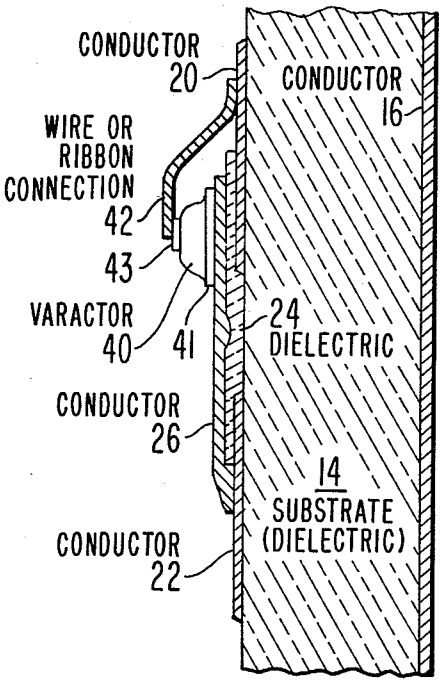
FIG. 4 is a sectional view taken on the line 4—4 of FIG. 1.

As shown to advantage in FIG. 4, an electrically-controllable capacitor, such as a varactor 40, has one terminal 41 mounted on the near end of conductor 26 which is connected along its length with conductor 22, and has its other terminal 43 connected by a conductive wire or ribbon 42 to the near end of conductor 20. The variable varactor capacitor may be a Type DT tuning varactor made by Crown Microwave, Inc., N. Billerica, MA 01862. The tuning varactor selected may have a capacitance of 10, 20 or 30 picofarads and an adjustment range of 5.6 or 7-to-1 in capacitance as the result of the application to the varactor of a direct-current control voltage in the range from 0.5 volts to 50 volts.

Figure 5:
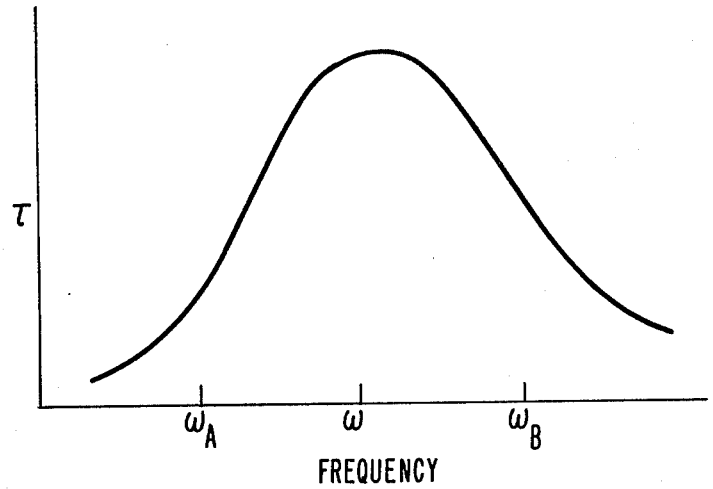
FIG. 5 is a chart showing the phase delay characteristic of a phase equalizer.

A direct-current control or bias voltage is supplied to the varactor 40 from a source (not shown) through a stripline radio-frequency "choke", and bypass circuit. The circuit includes a large-area conductor 50 (FIGS. 1 and 2) connected to a bias supply terminal 52 to provide capacitance to ground to bypass radio-frequency energy and thereby prevent its transmission to the bias power supply. The terminal 52 is connected by a quarter-wavelength-long thin strip conductor 54 to the input strip conductor 10. Since the conductor 54 is a quarter-wavelength-long and is shorted at 52, it presents a high impedance open circuit to radio frequency energy where it is connected to input strip conductor 10. The direct current path from bias terminal 52 includes quarter-wavelength conductor 54, input conductor 10, strip conductor 20 and ribbon connection 42 to terminal 43 of the varactor 40. Another quarter-wavelength-long thin strip conductor 56 connects another bias voltage source terminal 58 to the output strip conductor 12, from which electrical connection is made through strip conductors 22 and 26 to the other electrical terminal 41 of the varactor 40. The described construction permits the supplying of a direct-current voltage to the varactor 40 while permitting a flow of radio-frequency energy from input strip conductor 10 to output strip conductor 12, and while blocking and bypassing the flow of radio-frequency energy to the bias-voltage source, The phase equalizer of FIGS. 1 through 4 has a phase delay response as shown by the chart of FIG. 5, where the frequencies may be in the 3 and 4 gigahertz range in the middle of the microwave S band. The center frequency of the response may be varied by varying the direct-current bias to the varactor 40.

Figure 6:
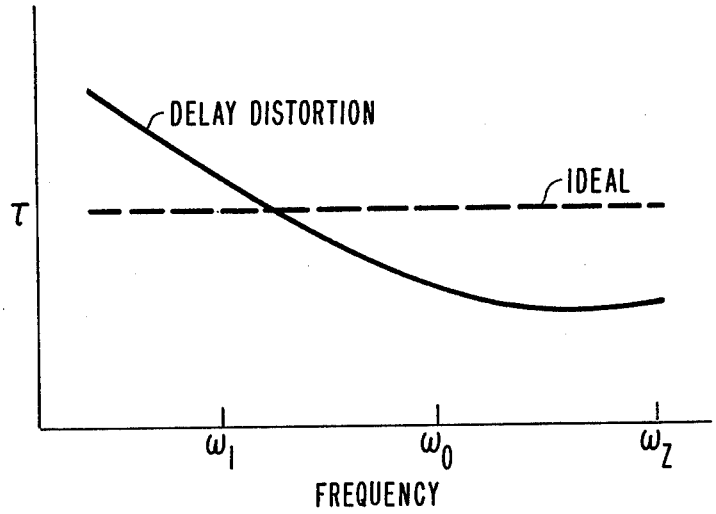
FIG. 6 is a chart showing the actual and ideal phase delay characteristics of a typical microwave transmission line.
Figure 7:
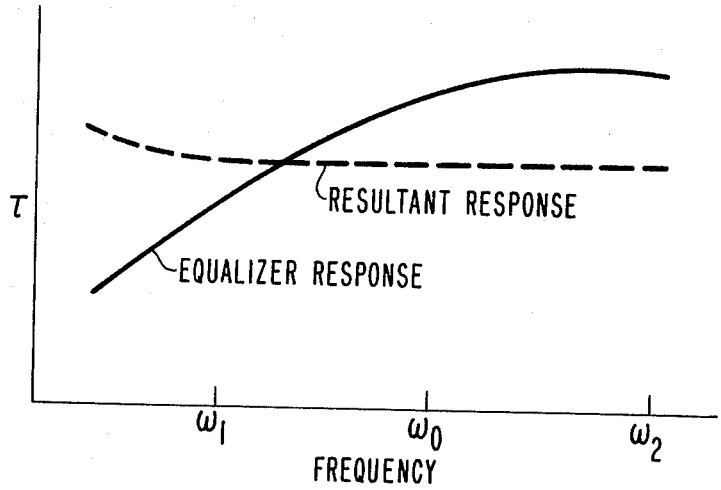
FIG. 7 is a chart showing the resultant corrected phase response obtained when corrected by a plurality of phase equalizers.

FIG. 6 shows an example of actual and ideal delay distortion responses of a microwave transmission system. FIG. 7 shows how the addition of phase equalizer means can make a resultant response, shown by dashed line, approach the ideal response shown in FIG. 6. The equalizer response of FIG. 7 when added to the delay distortion characteristic of FIG. 6 results in a resultant response as shown in FIG. 7.

Figure 8:
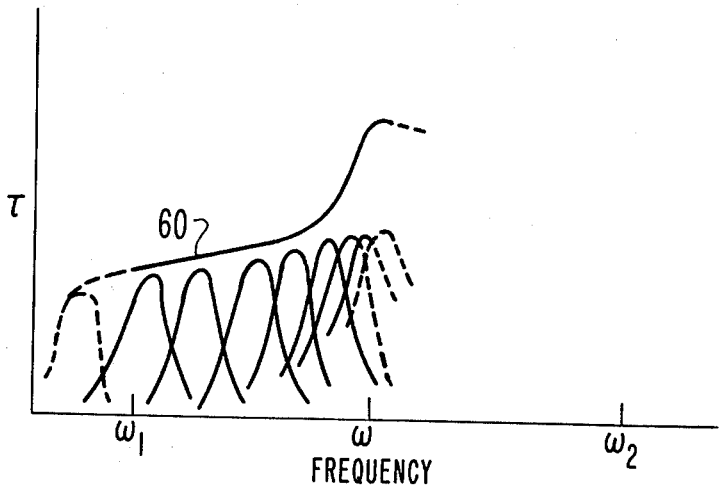
FIG. 8 is a chart showing a phase response characteristic obtainable when a transmission system is provided with a plurality of phase equalizers like the one shown in FIG. 1.

When it is desired to extend the phase correction over a considerable frequency band, it is necessary to employ a plurality of equalizers, as shown in FIGS. 1 through 4, distributed along the microwave transmission system. Each equalizer should be tuned to a different resonant frequency, as shown by the several characteristics in FIG. 8. The total effect of all of the equalizers then may be as shown by the characteristic 60. The tuning of each of the equalizers is accomplished by appropriately dimensioning the elements of the equalizers to provide needed values of capacitance and inductance. An additional control of the final tuning is provided by the application of control voltages to the varactors so that they have values of capacitance needed to give the equalizers the desired phase delay characteristics.

What is claimed is:

1. A resonant circuit phase equalizer in a microwave stripline transmission line having a planar substrate with a ground plane conductor on the bottom surface and input and output strip conductors on the top surface, comprising two quarter-wavelength-long strip conductors extending in close parallel relationship on said substrate from integral contact with adjacent ends of respective input and output strip conductors, to capacitively couple microwave signals from said input strip conductor through said two parallel strip conductors to said output strip conductor, a first direct-current-blocking and radio-frequency tuning capacitor connected across the remote ends of said quarter-wave strip conductors, an electrically-controllable capacitor connected across the near ends of said quarter-wave strip conductors connected with said input and output strip conductors, and radio-frequency choke conductors on said substrate and connected to said input and output strip conductors through which to supply a variable direct-current bias voltage to said electrically-controllable capacitor to vary the capacitance thereof and the center frequency tuning of the resonant circuit.

2. An equalizer according to claim 1 wherein said first capacitor is a fixed capacitor.

3. An equalizer according to claim 1 wherein said electrically-controllable capacitor is a varactor.

4. An equalizer according to claim 1 wherein an insulating dielectric material is constructed over one of said quarter-wavelength-long strip conductors, and a third quarter-wavelength-long conductor is constructed over said insulating dielectric material and in contact with said second quarter-wavelength-long strip conductor along the length thereof.

5. An equalizer according to claim 1 wherein said input and output strip conductors extend in a straight line, and said two quarter-wavelength-long strip conductors extend at right angles with said straight line.

* * * * *